US006093062A

United States Patent [19]

Chiu

[11] Patent Number: 6,093,062

[45] Date of Patent: Jul. 25, 2000

[54] STRUCTURE OF A CONNECTOR TERMINAL

[75] Inventor: Te-Chao Chiu, Taipei Hsien, Taiwan

[73] Assignee: Wieson Electronic Co., Ltd., Taipei, Taiwan

[21] Appl. No.: 09/324,726

[22] Filed: Jun. 3, 1999

[51] Int. Cl.[7] ..... H01R 13/40

[52] U.S. Cl. ..... 439/733.1; 439/869

[58] Field of Search ..... 439/733.1, 444, 439/869, 862, 636

[56] References Cited

U.S. PATENT DOCUMENTS

| | | | |
|---|---|---|---|
| 4,775,336 | 10/1988 | Paulo | 439/733.1 |
| 4,842,528 | 6/1989 | Frantz | 439/733.1 |
| 5,362,256 | 11/1994 | Hashiguchi | 439/733.1 |
| 5,688,149 | 11/1997 | Aihara | 439/733.1 |

*Primary Examiner*—Hien Vu

*Attorney, Agent, or Firm*—Jacobson, Price, Holman & Stern, PLLC

[57] ABSTRACT

An improved structure of a connector terminal is disclosed. A material belt is punched with a bank of plural female terminals. One end of each female terminal is connected to the material belt, and the end of the female terminal connected to the material belt is punched to be as a slender waist portion. The middle portion of the female terminal is punched to form as a U shape middle portion, and an inserting end is formed on the outermost end of the female terminal. The inserting end has an arc shape cross section so that the gap in the female terminal is reduced. A flat portion is formed between the inserting end and the middle portion. Two sides of the flat portion are formed with reversing teeth so that it can be steadily arranged within a connector. Moreover, since the inserting end of the female terminal is an open arc, thus the whole structure can be plated. As a consequence, the contact area with a male terminal is enlarged, and thus bad contact is avoided. Another, since the inserting end has an arc shape, the expanding area is reduced. The distance between two female terminals is decreased and the cost thereof is therefore reduced.

1 Claim, 4 Drawing Sheets

STRUCTURE OF A CONNECTOR TERMINAL

BACKGROUND OF THE INVENTION

1. Field of the Invention

The present invention relates to an improved structure of a connector terminal, and especially to a female terminal the front end of which has an open arc so that the distance between two female terminals are reduced. Therefore, the required material is reduced, and it is easily plated and has a larger contact area so as to increase conductivity.

2. Description of the Prior Art

With reference to FIG. 4, in prior art connector terminal, a material belt a is punched with a bank of a plurality of female terminals b, one end of each female terminal b is connected to the material belt a, and the end of the female terminal b connected to the material belt a is punched as a slender waist portion b1, the middle portion of the female terminal is punched to form as a U shape middle portion b2. The outermost end of the female terminal b is formed with an inserting end b3 with a round cross section. Moreover, a bridge b4 is connected between two female terminals b and the middle portion b2.

Since the female terminal b is continuously punched from a long material belt 1 and the inserting end b3 in front of the female terminal b has a round cross section. While the peripheral length of an expanding inserting end b3 is equal to the distance between centers of two female terminals b. The peripheral length of the expanding inserting end b3 is the largest dimension, other portion need not require such a large area. The inserting end b3 occupies only a small part of the female terminal b. As a result, the prior art design wastes much material.

Moreover, since the cross section of the inserting end b3 has a round shape, theoretically, round shape has a largest contact area. However, in practice, it is impossible to punch the inserting end with a minor diameter so as to form with a real round shape. Therefore, when a male terminal (not shown) is inserted into the inserting end b3 of a female terminal b, only a small contact area is formed therebetween. Thus, the contact effect is not preferred, and so does the conductivity.

Further, since, a metal with high conductivity must be further plated to a punched female terminal b so as to have a preferred conductivity. However, since when the inserting end b3 with a round shape is plated, the current will flow along a shortest path and thus free electrons will also flow along the shortest path to the outer surface of the female terminal b. While the portion in the inner radius of the inserting end b3 has a largest distance, thus free metal ions will not easily flow into the deepest portion in the interior of the inserting end 13. Thus it can not be plated in the inner radius of the inserting end b3. The portion required to have a high conductivity in the inserting end b3 can not be plated. Accordingly, the plating process has no practical means.

Since the female terminal b of a prior art connector has an inserting end b3 with a round cross section, too much material is wasted and a real round shape is not easily manufactured, and therefore the contact area is reduced so as to reduce conductivity of the female terminal. Moreover, the plating process is difficult to perform. Accordingly, there is an eager demand for a novel improved structure of a connector terminal, which may improve the defects in the prior art.

SUMMARY OF THE INVENTION

Accordingly, the object of the present invention is to provide an improved structure of a connector terminal, wherein a material belt is punched with a bank of plural female terminals, one end of each female terminal is connected to the material belt, and the end of the female terminal connected to the material belt is punched to be as a slender waist portion. The middle portion of the female terminal is punched to form as a U shape middle portion, and an inserting end is formed on the outermost end of the female terminal. The inserting end has an arc shape cross section so that the gap in the female terminal is reduced, a flat portion is formed between the inserting end and the middle portion, two sides of the flat portion are formed with reversing teeth so that it can be steadily arranged within a connector. Moreover, since the inserting end of the female terminal is an open arc, thus the whole structure can be plated. As a consequence, the contact area with a male terminal is enlarged. Thus, bad contact is avoided. Another, since the inserting end has an arc shape, the expanding area is reduced. The distance between two female terminals is decreased and the cost thereof is therefore reduced.

The present invention will be better understood and its numerous objects and advantages will become apparent to those skilled in the art by referencing to the following drawings in which:

DETAILED DESCRIPTION OF THE PREFERRED EMBODIMENT

Figure 1:
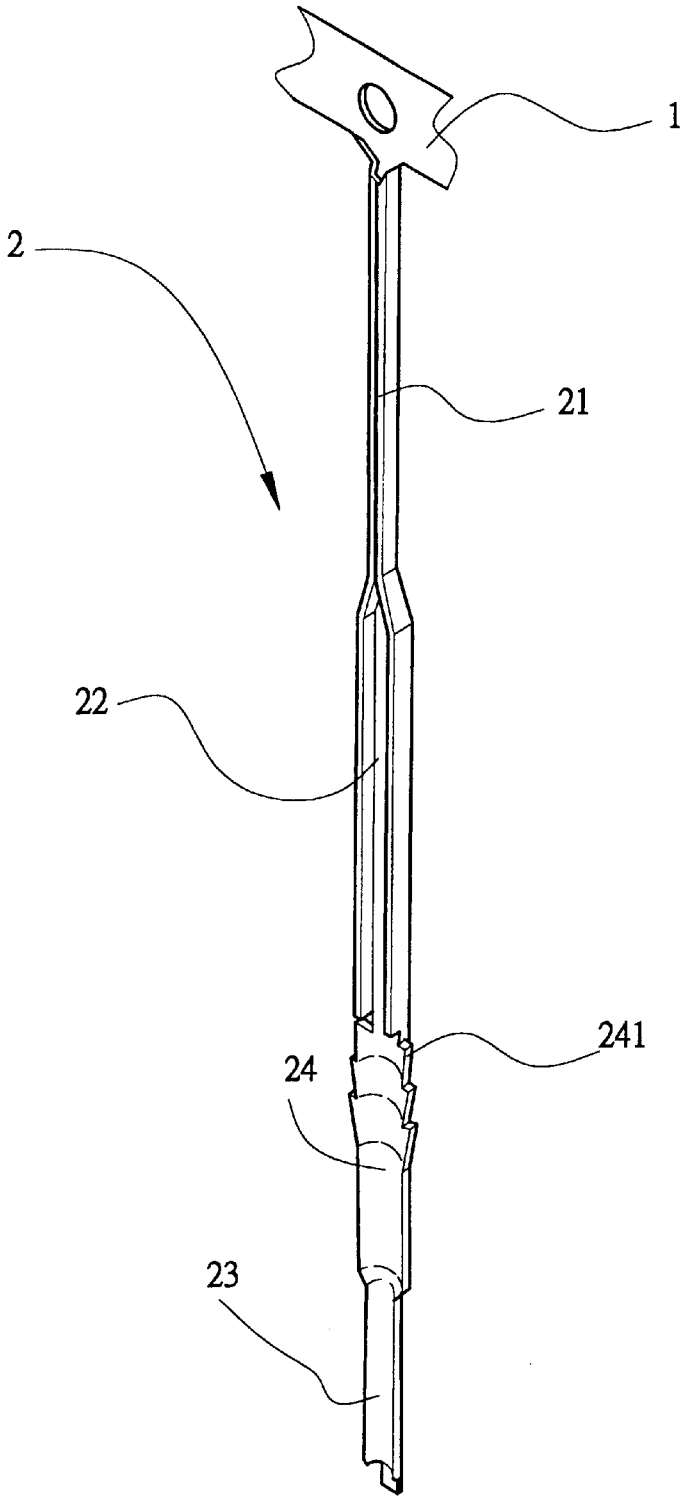
FIG. 1 is a perspective view of the present invention.
Figure 2:
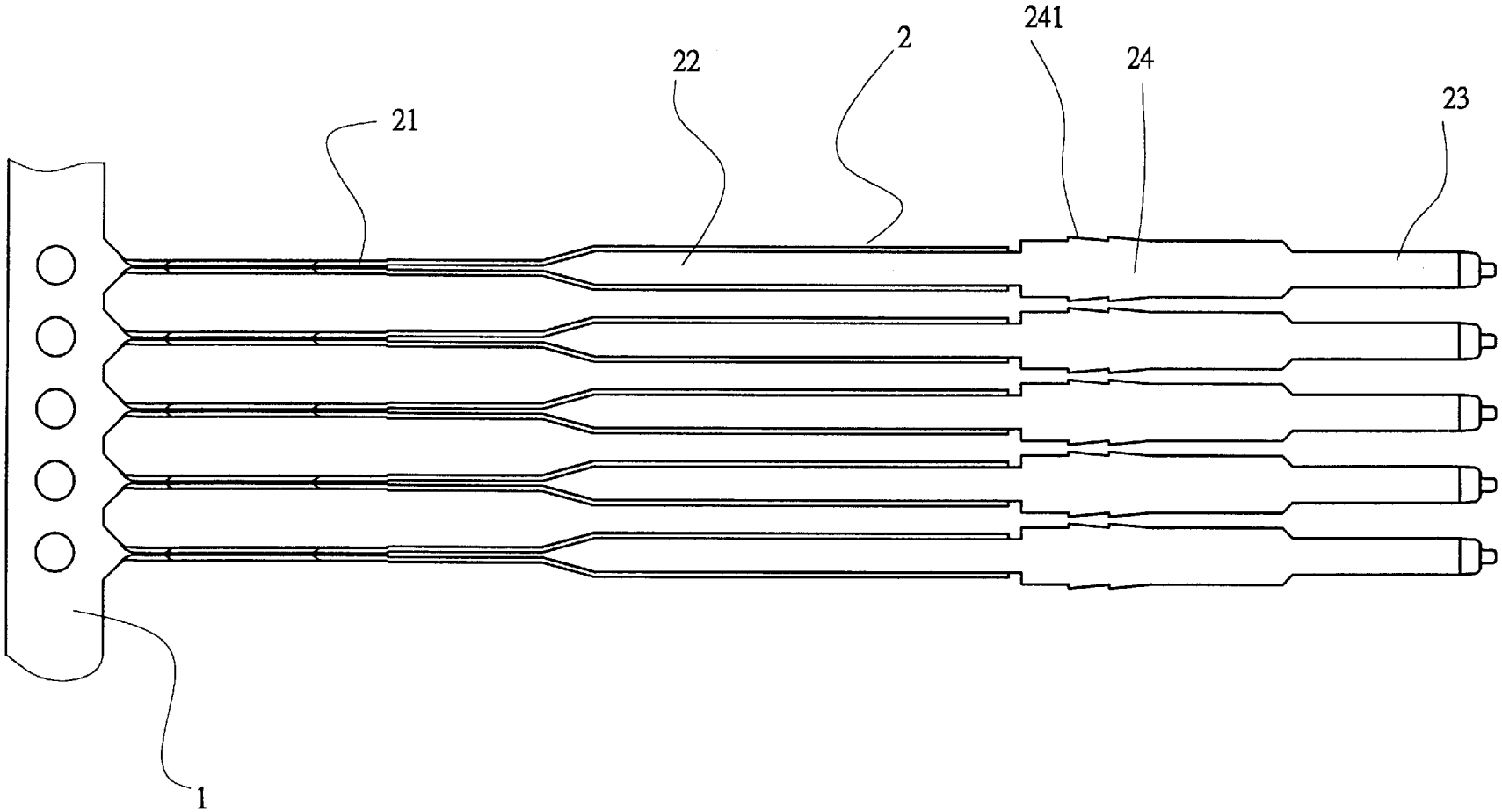
FIG. 2 is a front view of the present invention.
Figure 3:
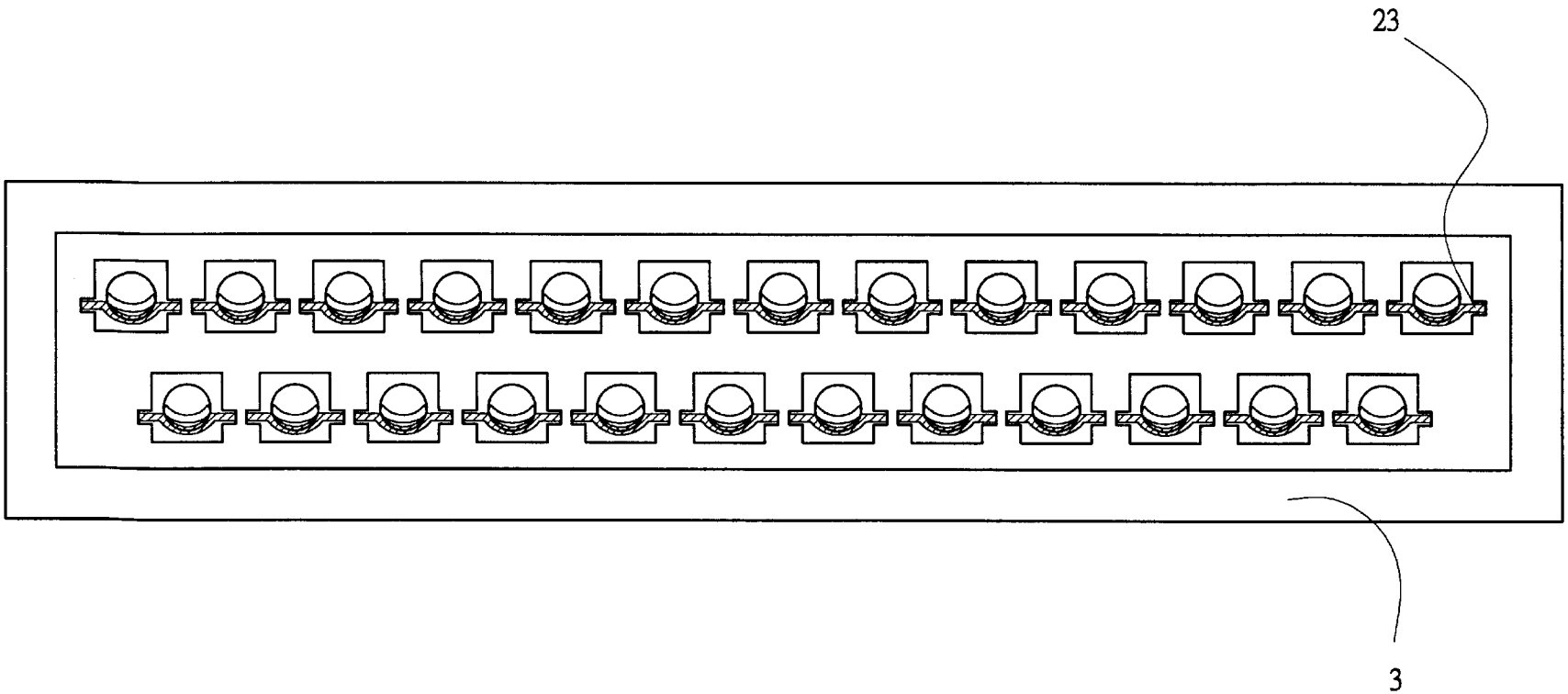
FIG. 3 is an end view showing that the present invention is installed in a connector.
Figure 4:
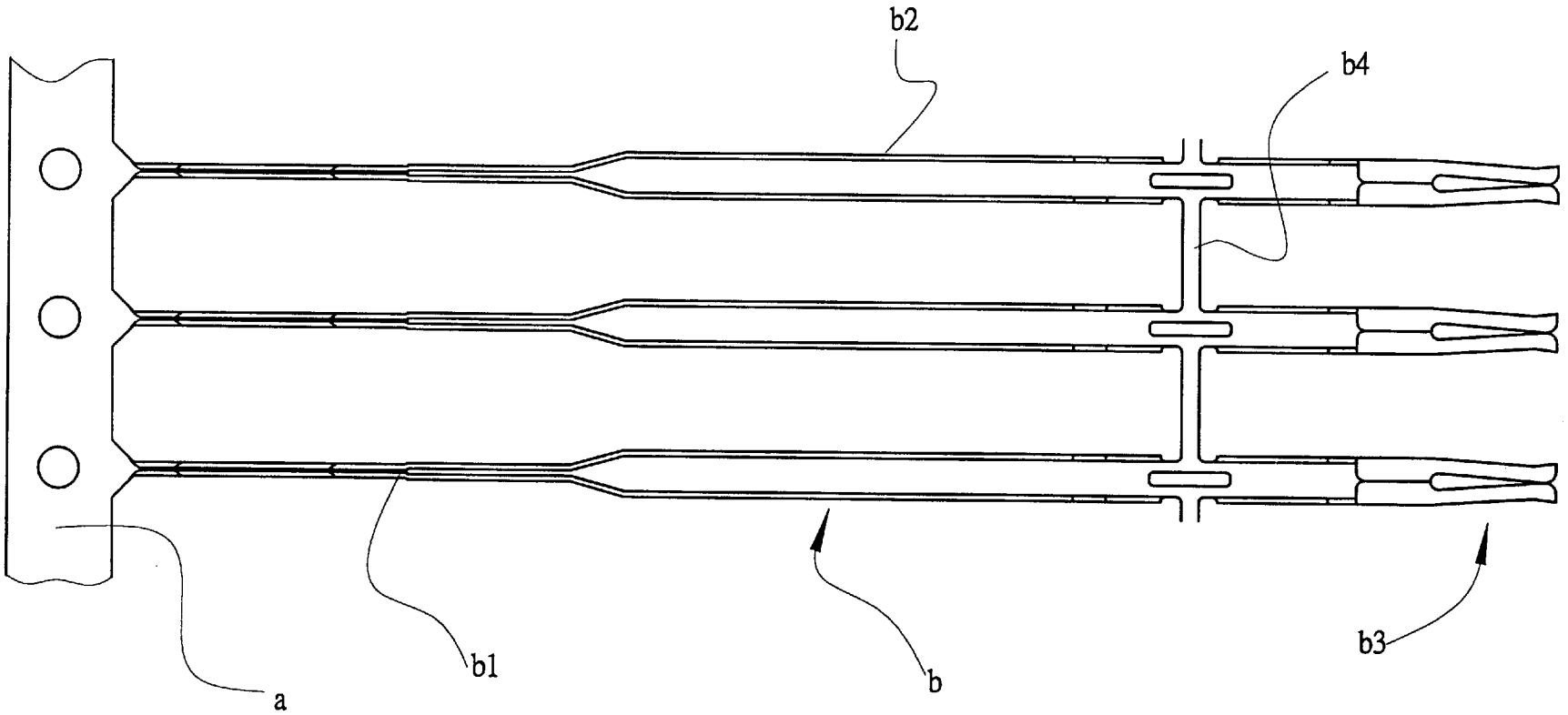
FIG. 4 (PRIOR ART)
FIG. 4 shows a front view of a prior art.

Referring to FIGS. 1 and 2, in the present invention, a material belt 1 is punched with a bank of plural female terminals 2. One end of each female terminal is connected to the material belt 1. The end of the female terminal 2 connected to the material belt 1 is punched to be as a slender waist portion 21. The middle portion of the female terminal 2 is punched to form as a U shape middle portion 22, and an inserting end 23 is formed on the outermost end of the female terminal 2.

The inserting end 23 has an arc shape cross section so that the gap in the female terminal 2 is reduced. A flat portion 24 is formed between the inserting end 23 and the middle portion. Two sides of the flat portion are formed with reversing teeth 241 so that it can be steadily arranged within a connector 3.

According to aforementioned structure, since the inserting end 23 of the female terminal 2 is an open arc so to reduce the expanding area of the inserting end 23 is reduced. Thus, the distance between two female terminals is reduced for saving more material.

Moreover, since the inserting end 23 of the female terminal 2 is an open arc, during plating, free metal electrons may be plated to the arc surface on the inserting end 23. Therefore, it does not be a round shape as that in the prior art which can not be plated in the inner portion. Thus, the present invention has a preferred contact conductivity.

Since the inserting end 23 of the female terminal 2 is an open arc, when a male terminal (not shown) is inserted into the inserting end 23 of the female terminal 2, the interruption may be reduced so that the contact area is increased. Thus, the present invention has a preferred conductivity. Therefore, a bad contact is avoided.

Furthermore, since the inserting end 23 of the female terminal 2 is an open arc, it can be manufactured easily without any trouble and therefore the cost is reduced.

Moreover, since a flat portion 24 is formed on the rear side of the inserting end 23 of the female terminal 2, and two sides thereof are formed with reversing teeth 241. Accordingly, by the reversing teeth 241 to eject the inner portion of the connector 3, the terminal is steadily arranged within the connector 3 and thus the female terminal will not vibrate.

Although the present invention has been described using specified embodiment, the examples are meant to be illustrative and not restrictive. It is clear that many other variations would be possible without departing from the basic approach, demonstrated in the present invention.

What is claimed is:

1. A connector terminal comprising:

a material belt punched with a bank of plural female connector terminals, one end of each female connector terminal being connected to the material belt, said one end of each female connector terminal connected to the material belt having a slender waist portion, a middle portion of the female connector terminal being a U shape middle portion, an inserting end of each female connector terminal being located at a free end of each female connector terminal, the inserting end having an arc shaped cross section and an end portion having a reduced thickness with a stepped surface with respect to an upper surface of said inserting end, a flat portion located between the inserting end and the middle portion, two sides of the flat portion including reversing teeth so that the female connector terminal is steadily arranged within a connector, and the slender waist portion, the middle portion, the flat portion and the arc shaped inserting end being substantially cortinously straight for insertion in a connector.

* * * * *